US005928540A

United States Patent [19]

Antoine et al.

[11] Patent Number: 5,928,540

[45] Date of Patent: Jul. 27, 1999

[54] RADIANT HEATING OVEN HAVING DOOR WITH REMOVABLE MODULE

[75] Inventors: Dominique Antoine, Cleurie; Michel Gass, St Ame, both of France

[73] Assignee: SEB S.A., Ecully, France

[21] Appl. No.: 08/620,338

[22] Filed: Mar. 22, 1996

[30] Foreign Application Priority Data

Mar. 24, 1995 [FR] France ..... 95 03743

[51] Int. Cl.[6] ..... H05B 6/76; F24C 15/04

[52] U.S. Cl. ..... 219/391; 219/739; 219/757; 126/198; 126/21 A

[58] Field of Search ..... 219/739, 740, 219/741, 742, 743, 757, 391; 126/190, 198, 200, 21 A; 432/250

[56] References Cited

U.S. PATENT DOCUMENTS

| | | | |
|---|---|---|---|
| 2,439,057 | 4/1948 | Russell | 126/190 |
| 2,503,076 | 4/1950 | Smith | 126/190 |
| 3,711,673 | 1/1973 | Takeda et al. | 219/740 |
| 3,808,391 | 4/1974 | Graff et al. | 219/739 |
| 4,041,930 | 8/1977 | Katona | 126/198 |
| 4,166,207 | 8/1979 | Burke | 219/743 |
| 4,711,982 | 12/1987 | Millman | 219/739 |
| 5,313,035 | 5/1994 | Chartrain et al. | 219/740 |

FOREIGN PATENT DOCUMENTS

| | | |
|---|---|---|
| 0 496 243 A2 | 7/1992 | European Pat. Off. . |
| 2 450 422 | 9/1980 | France . |
| 2 563 612 | 10/1985 | France . |
| 1 552 849 | 9/1979 | United Kingdom . |

*Primary Examiner*—Philip H. Leung
*Attorney, Agent, or Firm*—Pillsbury Madison & Sutro

[57] ABSTRACT

An oven door for closing a cooking chamber of an oven, the door being composed of: a frame on the oven; an inner wall and an outer wall both supported by the frame so that the inner wall is located between the cooking chamber and the outer wall, the inner wall and outer wall being positioned relative to one another to delimit an air space; and ventilation elements for establishing a flow of air between the inner wall and the outer wall in order to maintain the outer wall at a low temperature during a cooking operation, wherein the inner wall is made of glass, and the outer wall is removable from the frame and is made of a plastic material selected to withstand the temperatures to which it will be exposed during any cooking operation.

12 Claims, 2 Drawing Sheets

RADIANT HEATING OVEN HAVING DOOR WITH REMOVABLE MODULE

BACKGROUND OF THE INVENTION

The present invention relates to the field of household electric ovens intended for cooking of food products. The invention concerns more particularly an oven door which permits closing the oven enclosure in which are disposed heating units of the radiant type.

The present invention concerns portable ovens, countertop ovens, or even built-in ovens having an access door for the cooking enclosure.

It is already known, as disclosed for example in British patent GB-A-1552849, to provide an oven door provided with a double wall of glass permitting by the intermediary of a circulation of air between the two walls reduction of the temperature of the outer glass wall which is accessible to users during cooking operations. In addition, the exterior glass wall can be removed, or demantled, to facilitate cleaning operations.

Such an oven door presents particularly drawbacks relative to its construction. Such construction requires the utilization of a frame having a particular form and a rigidity sufficient to support the assembly constituted by two glass walls, or panels. One of them, being removable for cleaning, must in addition be provided with means for dismantling and replacing which are simple to utilize. All of these requirements have a negative impact on the manufacturing cost of such an oven.

It is also known, as disclosed in European patent EP-A-0496243, to provide an oven door comprising a shell having the general form of a parallelepiped, having a front wall made of a transparent polycarbonate plate; it is also associated with a metal frame which serves to prevent passage of radiation from the cooking enclosure when the oven is utilized in a microwave operation mode. Such a concept although particularly well adapted to microwave ovens can create problems in the case of conventional high power cooking. In effect, the metal frame does not permit sufficient filtration of the infrared radiation generated by high power cooking. The temperature rise of the outer wall which is accessible to users can thus not be maintained at an optimum temperature level without the risk of burns being suffered by the user, on the one hand, and without presenting the risk of deformation of the oven door on the other hand.

SUMMARY OF THE INVENTION

An object of the present invention is to remedy all of the shortcomings existing in the prior art and to provide an oven door which can be manufactured at lower cost, but is nevertheless capable of being utilized during cooking at very high powers.

Another object of the present invention is to provide an oven door having increased safety with respect to the risks of burns resulting from contact therewith.

A further object of the present invention is to provide an oven door which is easily fabricated on the one hand and improves the decorative appearance of the oven on the other hand.

Yet another object of the invention is to provide an oven whose door comprises a wall forming a removable module.

The above and other objects are achieved by an oven door for closing a cooking chamber of an oven, the door comprising: a frame on the oven; an inner wall and an outer wall both supported by the frame so that the inner wall is located between the cooking chamber and the outer wall, the inner wall and outer wall being positioned relative to one another to delimit an air space; and ventilation means for establishing a flow of air between the inner wall and the outer wall in order to maintain the outer wall at a low temperature during a cooking operation, wherein the inner wall is made of glass, and the outer wall is removable from the frame and is made of a plastic material selected to withstand the temperatures to which it will be exposed during any cooking operation.

BRIEF DESCRIPTION OF THE DRAWING

Other characteristics and advantages will become more readily apparent from a reading of the description presented below with reference to the following attached drawings which are presented by way of a nonlimiting example.

DESCRIPTION OF THE PREFERRED EMBODIMENTS

Figure 1:
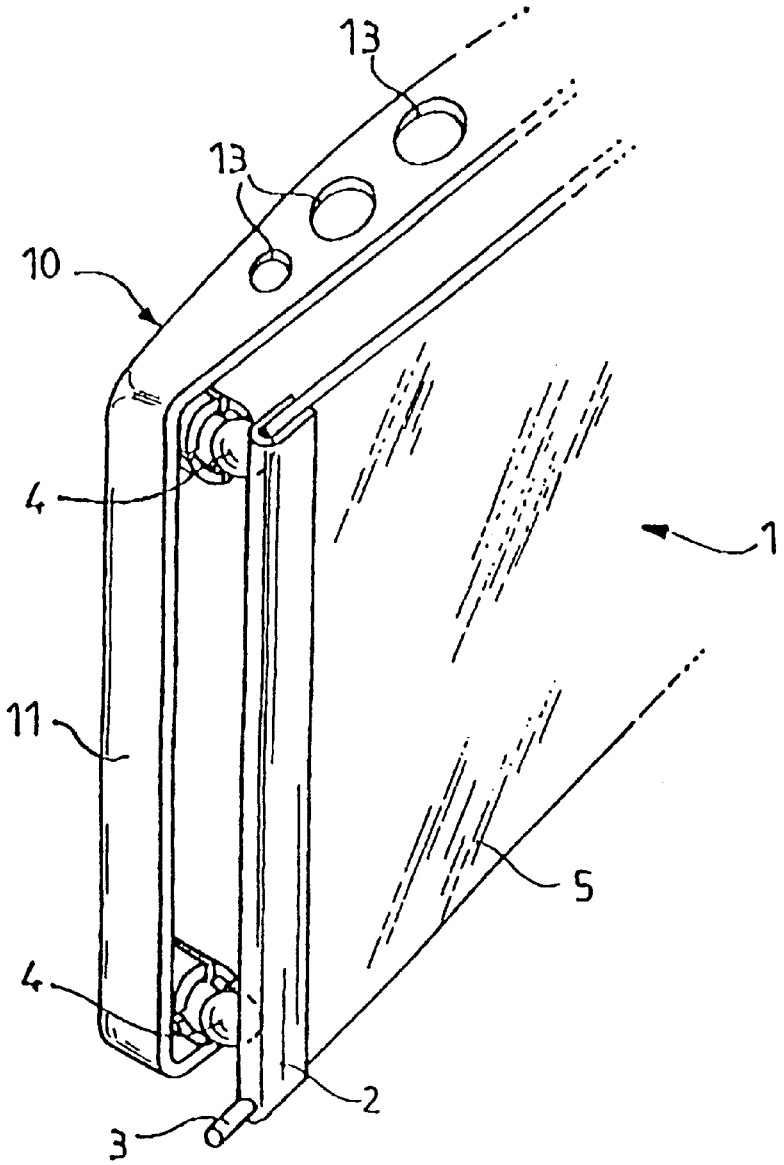
FIG. 1 is a partial perspective view of an embodiment of a door according to the invention.

As shown in FIG. 1, a door 1 according to the invention includes an inner wall 5 permitting complete closing of the oven cooking chamber during cooking operations. Inner wall 5 is advantageously made of glass in order to be, on the one hand, transparent and, on the other hand resistant to deformations associated with very high temperatures existing in the cooking chamber. In addition, inner wall 5 is fixed between two uprights 2 which are disposed along two opposite edges of inner wall 5.

Uprights 2 are provided with articulation means 3 via which door 1 is supported in the entrance to the cooking chamber and about which door 1 can swing or pivot in a reversible manner between a cooking chamber closing position and a cooking chamber opening position.

Articulation means 3 are constituted for example by cylindrical pins which extend within the plane of inner wall 5 in a manner to engage in bushings or bearings provided for this purpose in lateral sides of the oven. These articulation means are advantageously disposed in the vicinity of the bottom of uprights 2. Uprights 2 are preferably made of metal and have a U-shaped profile to straddle, or grip, opposed lateral edges of inner wall 5. Uprights 2 preferably extend over the entire height of inner wall 5 and articulation means 3 are preferably arranged toward the bottom of uprights 2. Articulation means 3 are for example soldered or riveted onto uprights 2.

Thus, in a simplified manner, oven door 1 includes a frame constituted by two uprights 2 and the inner wall 5.

According to an alternative embodiment of an oven door according to the invention, it is possible to utilize other known means to replace articulation means 3.

Oven door 1 according to the invention also includes an outer wall 10 which is fixed directly to the frame with the aid of fixing means. Outer wall 10 is secured directly to uprights 2 by fixation means arranged on uprights 2 and on outer wall 10. As a result, outer wall 10 and inner wall 5 form a double wall which improves the thermal insulation of oven door 1. Outer wall 10 is preferably removable from inner wall 5 and is made of a plastic material which is resistant to high temperatures and is compatible with any cooking operation. Advantageously, outer wall 10 is made of a polycarbonate. Inner and outer walls 5 and 10 are preferably both made of transparent materials. Polycarbonate offers, in addition, attractive mechanical properties. One type of polycarbonate that can be used for outer wall 10 is marketed under the commercial designation SINVET R201. It is to be understood that this specific composition is cited only as a non-limiting example.

The oven door 1 thus constructed, notably with outer wall 10 and inner wall 5, also includes ventilation means intended to generate a flow of air between walls 5 and 10 in a manner to reduce the temperature of outer wall 10 during cooking operations. The distance between inner wall 5 and outer wall 10 also permits an influence to be exerted on the temperature of outer wall 10.

The ventilation means are formed by appropriately configuring outer wall 10, and specifically by providing peripheral edge 11 of outer wall 10 with openings 13 which promote a natural convection flow between walls 5 and 10. Wall 10 has, for example, the form of a basin or pan, with peripheral edge 11 forming a border around wall 10. In addition, peripheral edge 11 is aligned with, and faces, the periphery of inner wall 5. According to one particular form of construction, the exposed, or outer, surfaces of oven door 1 can, during cooking operations, reach a temperature no higher than 80° C. when the temperature existing at the interior of the oven chamber rises to around 270° C.

Openings 13 are advantageously arranged in the upper part of peripheral edge 11. Other openings can advantageously be distributed along the bottom portion of edge 11 in order to provide air inlets. The fixation means for fixing outer wall 10 onto inner wall 5 are constituted by male and female parts composed, respectively, of balls 4 fixed to uprights 2 and spherical housings, or receptacles, 12 suitably located on outer wall 10 to be properly aligned with balls 4 when outer wall 10 is fixed to uprights 2. The fixation means are shown in a more detailed manner in FIG. 2, which illustrates particularly inner wall 5 being gripped by an upright 2, with a ball 4 having a substantially spherical shape soldered or welded onto upright 2 at the side of inner wall 5 which faces outwardly of the cooking chamber. Balls 4 are for example welded onto uprights 2. The spherical configuration of balls 4 enables them to have a very small area of contact with uprights 2 and consequently allows a reduction in the transfer of heat by conduction between uprights 2 and outer wall 10.

Figure 2:
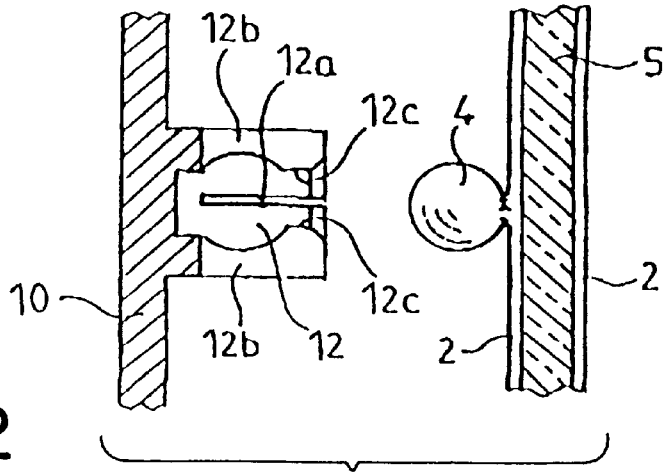
FIG. 2 is a cross-sectional detail view illustrating attachment means in the embodiment of FIG. 1.

Preferably, outer wall 10 and spherical receptacles 12 are formed by molding and are elastically deformable, in particular at the locations where balls 4 penetrate spherical receptacles 12. A spherical receptacle 12 is shown in FIG. 2 in cross section. A molding operation permits, in an easy and inexpensive manner, fabrication of spherical receptacles 12. These receptacles 12 are preferably disposed at the periphery of outer wall 10, just inside peripheral edge 11 and preferably in the corners of the basin forming outer wall 10. Spherical receptacles 12 have a narrowed portion, or neck, 12c at their open end in order to present a resistance to insertion and removal of an associated ball 4. Advantageously, the material from which spherical housings are made can give them the requisite elasticity. Externally, spherical receptacles 12 have the form of cylinders each extending along an axis aligned with an associated ball 4 when outer wall 10 is correctly positioned opposite to uprights 2 in order to permit cooperation between the fixation means. The external cylindrical configuration of each receptacle 12 is advantageously provided with slits 12*a* which promote spreading apart of portions 12*b* of each receptacle 12 in an elastic manner when an associated spherical ball penetrates into spherical receptacle 12 after having crossed neck 12c. The dimensions of each ball 4 thus correspond substantially to the dimensions of the associated spherical receptacle 12 and the portions 12*b* of receptacle 12 return substantially to their rest position when a ball 4 has been totally introduced into spherical receptacle 12, this being due to the restoring force associated with the elasticity of the material constituting outer wall 10. Outer wall 10, preferably removable and transparent, is thus fixed onto uprights 2 by a simple plugging operation in order to become an integral part of oven door 1 according to the invention. Outer wall 10 is thus a removable module of door 1.

According to another embodiment of oven door 1 according to the invention, the male parts of the fixation means are mounted on outer wall 10 and the female parts of the fixation means are provided on uprights 2.

Figure 3:
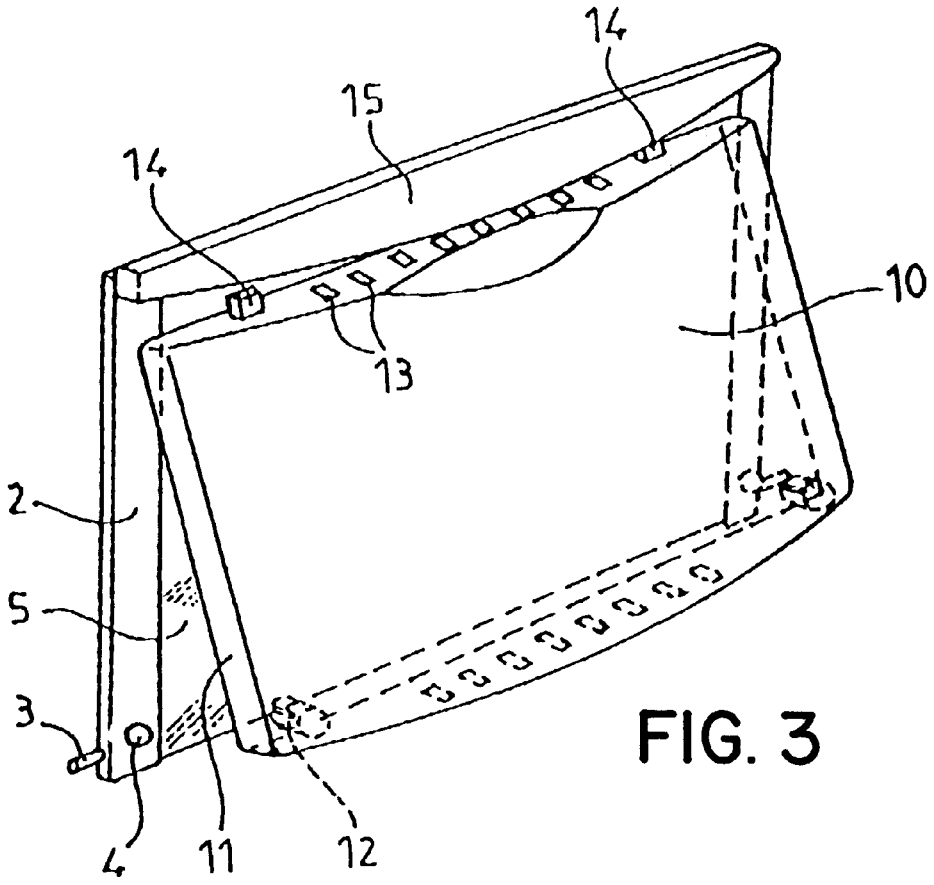
FIG. 3 is a perspective view of an alternative embodiment of a door according to the present invention.

According to an embodiment of the invention illustrated in FIG. 3, the fixation means are constituted by spherical receptacles 12 on outer wall 10 and balls 4 on uprights 2 at the lower part of oven door 1, along with positioning tongues 14 located at the top of outer wall 10 and projecting beyond peripheral edge 11 in order to engage in openings or recesses (not visible) provided in a hand grip 15. Hand grip 15 is fixed to the upper ends of uprights 2 and/or to inner wall 5. Hand grip 15 preferably projects in a direction perpendicular to the plane of inner wall 5 and beyond the assembly constituted by inner wall 5 and outer wall 10 to enable it to be gripped by the user in order to effect opening or closing of oven door 1. Fixing of outer wall 10 of the embodiment shown in FIG. 3 is also achieved by a plugging operation, at the lower part of oven door 1, between balls 4 and spherical receptacles 12. A simple pressure on outer wall 10 after it has been correctly positioned relative to inner wall 5 thus permits fastening of outer wall 10 is a removable manner on inner wall 5 by this simple plugging operation following proper engagement of positioning tongues 14 in their associated recesses.

Advantageously, oven door 1 also comprises means for filtering infrared radiation generated by an electric heating resistance which is brought to a high temperature in order to perform a browning, or grilling, function, for example. The filtration means are, for example, constituted entirely or in part by a radiation reflecting surface, constituted for example by a coating deposited by any known means on inner wall 5 which closes the cooking chamber. The reflecting surface is, for example, constituted by a layer of tin oxide. The radiation filtering means can also be constituted, for example, by a plate or sheet of metal which has been perforated in any known manner and which is fixed by any known means either on inner wall 5 or on outer wall 10.

Cooking ovens containing radiant heating elements arranged in the cooking enclosure, which is closed by an oven door 1 according to the invention, thus present an advantage in that outer wall 10 will remain at a low temperature which reduces the risks to the user of suffering burns as a result of touching outer wall 10. The reduction of the temperature of outer wall 10 is aided on the one hand by the distance existing between outer wall 10 and inner wall 5, and on the other hand by the presence of a flow of air circulating between walls 5 and 10, the air escaping from the space particularly via openings 13 formed in peripheral edge 11.

The flow of air, or a sheet of air, circulating between inner wall and outer wall 10 is produced either by natural convection or by the provision in the oven of an electrically driven ventilator which promotes such air flow. This air flow is preferably not in contact with the atmosphere within the cooking enclosure when oven door 1 is closed. Therefore, cooking vapors will not pass to the region outside of the oven and will therefore not form deposits in the space between inner wall 5 and outer wall 10.

Oven door 1 according to the invention presents the advantage that outer wall 10 is removable without requiring complicated disconnection operations. Therefore, outer wall 10 can be easily removed for cleaning, can be placed in a dishwasher, or temporarily removed in order to save space.

Another advantage of oven door 1 according to the invention resides in the possibility of fabricating outer wall 10 as a one-piece unit by a single molding operation, thus reducing fabrication costs.

Another advantage of oven door 1 according to the invention resides in the small number of pieces constituting door 1 since it is preferably constituted by only three separate pieces, i.e. inner wall 5, outer wall 10 and uprights 2.

A further advantage of oven door 1 according to the invention derives from the particular fixation means used to fasten outer wall 10 to inner wall 5, which enables oven door 1 to be provided with a frame which consists of only two uprights 2 possibly associated with a hand grip.

Yet another advantage of oven door 1 according to the invention resides in the utilization of a material of the polycarbonate type which can be used to produce, by a single simple molding operation on the one hand outer wall 10 and on the other hand one part of the fixation means intended for assembling walls 5 and 10 together.

A supplemental advantage of oven door 1 according to the invention resides in its attractive appearance, due primarily to the fact that outer wall 10 can be made of a plastic material capable of being given any desired pleasing form and color.

Figure 4:
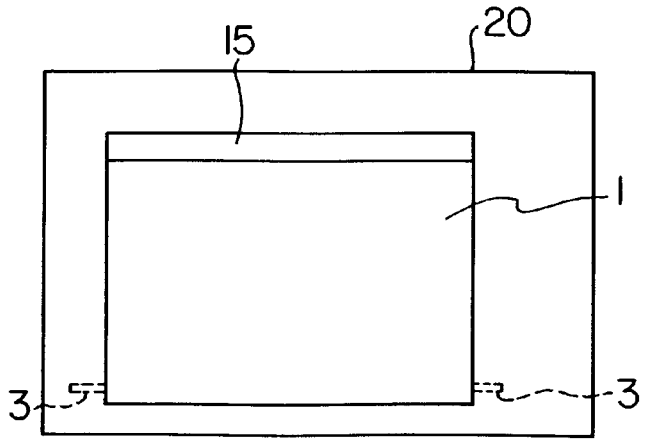
FIG. 4 is a front elevational view of an oven equipped with a door according to the present invention.

FIG. 4 is a front elevational view showing a door 1 according to the present invention installed in the cooking chamber entrance of a countertop or wall mounted oven 20 which may contain a radiant heating source. FIG. 4 also illustrates the location of articulation means 3 in such an oven. Apart from door 1, oven 20 may be of any conventional type.

This application relates to subject matter disclosed in French Application number 95 03743, filed on Mar. 24, 1995, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. An oven door for closing an entrance to a cooking chamber of a radiant heating oven, said door comprising: a frame constructed to be mounted on the oven at the entrance to the cooking chamber; an inner wall and an outer wall both supported by said frame so that when said frame is mounted on the oven, said inner wall will be located between the cooking chamber and said outer wall, said inner wall and outer wall being positioned relative to one another to delimit an air space; and ventilation means for establishing a flow of air between said inner wall and said outer wall in order to maintain said outer wall at a low temperature during a cooking operation, wherein said inner wall is made of glass, and said outer wall is removable from said frame and is made of a plastic material selected to withstand the temperatures to which it will be exposed during any cooking operation and wherein said oven door further comprises attachment means composed of elements secured to said uprights and to said outer wall for removably attaching said outer wall to said uprights said attachment means comprising male elements in the form of balls and female elements in the form of spherical receptacles, said male elements and said female elements being fixed, respectively, to said uprights and to said outer wall in order for said spherical receptacles to cooperate with said balls when said outer wall is attached to said uprights.

2. The oven door according to claim 1 wherein the plastic material of said outer wall is a polycarbonate.

3. The oven door according to claim 2 wherein said inner wall has two opposed lateral edges, and said frame is constituted by two lateral uprights each gripping a respective lateral edge of said inner wall.

4. The oven door according to claim 1 wherein said outer wall comprises a peripheral edge provided with openings located to promote the flow of air between said inner wall and said outer wall by convection and forming said ventilation means.

5. The oven door according to claim 4 wherein said outer wall and said receptacles are fabricated by molding and said receptacles are elastically deformable in response to insertion of said balls in said receptacles.

6. The oven door according to claim 1 wherein said outer wall and said receptacles are fabricated by molding and said receptacles are elastically deformable in response to insertion of said balls in said receptacles.

7. The oven door according to claim 1 wherein said inner wall has two opposed lateral edges, and said frame is constituted by two lateral uprights each gripping a respective lateral edge of said inner wall.

8. The oven door according to claim 7 wherein said outer wall comprises a peripheral edge provided with openings located to promote the flow of air between said inner wall and said outer wall by convection and forming said ventilation means.

9. The oven door according to claim 7 wherein said outer wall and said receptacles are fabricated by molding and said receptacles are elastically deformable in response to insertion of said balls in said receptacles.

10. The oven door according to claim 1 wherein said outer wall has a peripheral edge with substantially horizontal upper and lower edge portions and each of said upper and lower edge portions is provided with a plurality of openings to promote the flow of air between said inner wall and said outer wall by convection, the openings and the air space between said inner and outer wall forming said ventilation means.

11. A radiant heating oven having a cooking chamber with an entrance, said oven comprising an oven door for closing said cooking chamber, said oven door comprising: a frame on the oven; an inner wall and an outer wall both supported by said frame so that said inner wall is located between the cooking chamber and said outer wall, said inner wall and outer wall being positioned relative to one another to delimit an air space; and ventilation means for establishing a flow of air between said inner wall and said outer wall in order to maintain said outer wall at a low temperature during a cooking operation, wherein said inner wall is made of glass, and said outer wall is removable from said frame and is made of a plastic material selected to withstand the temperatures to which it will be exposed during any cooking operation, and wherein said oven door further comprises attachment means composed of elements secured to said uprights and to said outer wall for removably attaching said outer wall to said uprights said attachment means comprising male elements in the form of balls and female elements in the form of spherical receptacles, said male elements and said female elements being fixed, respectively, to said uprights and to said outer wall in order for said spherical receptacles to cooperate with said balls when said outer wall is attached to said uprights.

12. The radiant heating oven according to claim 11 wherein said outer wall has a peripheral edge with substantially horizontal upper and lower edge portions and each of said upper and lower edge portions is provided with a plurality of openings to promote the flow of air between said inner wall and said outer wall by convection, the openings and the air space between said inner and outer wall forming said ventilation means.

* * * * *